US006527634B2

(12) United States Patent
Lee et al.

(10) Patent No.: US 6,527,634 B2
(45) Date of Patent: Mar. 4, 2003

(54) GRINDING WHEEL WITH SEGMENTS FOR PREVENTING ONE-SIDED WEAR

(75) Inventors: Chang Hyun Lee, Kyongki-Do (KR); Joon Ho Chang, Jeonrabuk-Do (KR)

(73) Assignee: Ehwa Diamond Ind. Co., Ltd. (KR)

( * ) Notice: Subject to any disclaimer, the term of this patent is extended or adjusted under 35 U.S.C. 154(b) by 0 days.

(21) Appl. No.: 09/886,287

(22) Filed: Jun. 22, 2001

(65) Prior Publication Data

US 2002/0115398 A1 Aug. 22, 2002

(30) Foreign Application Priority Data

Feb. 19, 2001 (KR) ..... 2001-8265

(51) Int. Cl.[7] ..... B23F 21/03
(52) U.S. Cl. ..... 451/548; 451/540
(58) Field of Search ..... 451/461, 540, 451/550, 548, 549, 546, 551

(56) References Cited

U.S. PATENT DOCUMENTS 5,247,765 A * 9/1993 Quintana ..... 451/548
5,431,596 A * 7/1995 Akita et al. ..... 451/540
5,911,620 A * 6/1999 Spangenberg et al. ..... 451/548
6,299,522 B1 * 10/2001 Lee ..... 451/548
6,402,600 B1 * 6/2002 Besch ..... 451/268

* cited by examiner

*Primary Examiner*—George Nguyen
*Assistant Examiner*—Dung Van Nguyen
(74) *Attorney, Agent, or Firm*—Burns Doane Swecker & Mathis, LLP

(57) ABSTRACT

The present invention is intended to provide a grinding wheel which is prevented from the one-sided wear or the wear taking place intensively at the outer side of the segments due to working load so as to improve the processed quality of the ground surface. Thus the invention proposes a grinding wheel comprising a plurality of segments attached to the underside of a rim part of a grinding wheel, a rim part for supporting the segments, rib parts for connecting the rim part with a disk part, and a disk part with a central hole for connection to a motor-operated tool, wherein the segments are each demarcated into the inner portion and outer portion around the demarcating interface and the outer portions are so treated as to constitute a higher wear resisting region than the inner portions by controlling the particle size and/or the content of the super abrasive and/or by controlling the hardness of the metal bonding material for binding the abrasive particles together, in order to prevent one-sided wear.

6 Claims, 3 Drawing Sheets

GRINDING WHEEL WITH SEGMENTS FOR PREVENTING ONE-SIDED WEAR

FIELD OF THE INVENTION

The present invention relates to a grinding wheel for grinding various hard materials such as granite, tiles, bricks, concrete blocks and the like by using grinding materials including the diamond and more particularly to a grinding wheel which is prevented from the one-sided wear or the wear taking place intensively at the outer side of the segments due to working load so as to improve the processed quality of the ground surface.

BACKGROUND OF THE INVENTION

Generally, a grinding wheel is manufactured by a process comprising the steps of blending the diamond particles, cubic boron-nitride (CBN) particles or other super abrasive particles for acting as "grinding blades", together with the metal powder, resin or ceramic powder for supporting the abrasive particles and enabling sustained self-regeneration of the abrasive particles, compacting the resulting blend and subsequently subjecting the compacted segment to sintering, so that segments may be produced and then fixing the sintered segments to a bearing part or a "shank" for imparting rotating function by means of welding, soldering or adhesion.

The grinding wheel is caused to rotate at a high speed such as about 10,000 rpm corresponding to the circumferential velocity of about 70 to 80 m/sec to give grinding ability to the segments, wherein the abraded iron dust and ground scraps from the article being ground is subjected to a high centrifugal force and so the segments experience doubly severe grinding load.

A careful examination of segments in service reveals that the segments are worn out on the outer edge area intensively.

Such a one-sided wear may be attributable to the fact that at every grinding movement in a longitudinal or lateral direction, the segments are exposed to a higher grinding load at the outer area than at the inner area.

Because of this biased wear at outer area of segments, the grinding wheel must be replaced prematurely before the inner part of segments is worn out much. On the other hand, the processed quality of a ground surface can be poor at the location corresponding to the outer area of segments due to this biased wear.

SUMMARY OF THE INVENTION

The present invention was created in consideration of the above described circumstances, the object of the invention is to provide a grinding wheel which can be prevented from the one-sided wear or the wear taking place intensively at the outer side of the segments due to working load so as to improve the processed quality of the ground surface and thus to prolong the service life of a diamond tool.

The object as described above is achieved according to an aspect of the invention by a grinding wheel comprising a plurality of segments attached to the underside of a rim part of a grinding wheel, a rim part for supporting the segments, rib parts for connecting the rim part with a disk part, and a disk part with a central hole for connection to a motor-operated tool, wherein the segments are each demarcated into the inner part and outer part around the demarcating interface and the outer parts are so treated as to constitute a higher wear resisting region than the inner parts by controlling the particle size and/or the content of the super abrasive or by controlling the binding strength of the metal bonding material for binding the abrasive particles together.

DESCRIPTION OF THE PREFERRED EMBODIMENTS

Preferred embodiments are described in detail below by referring to the accompanying drawings.

Figure 1:
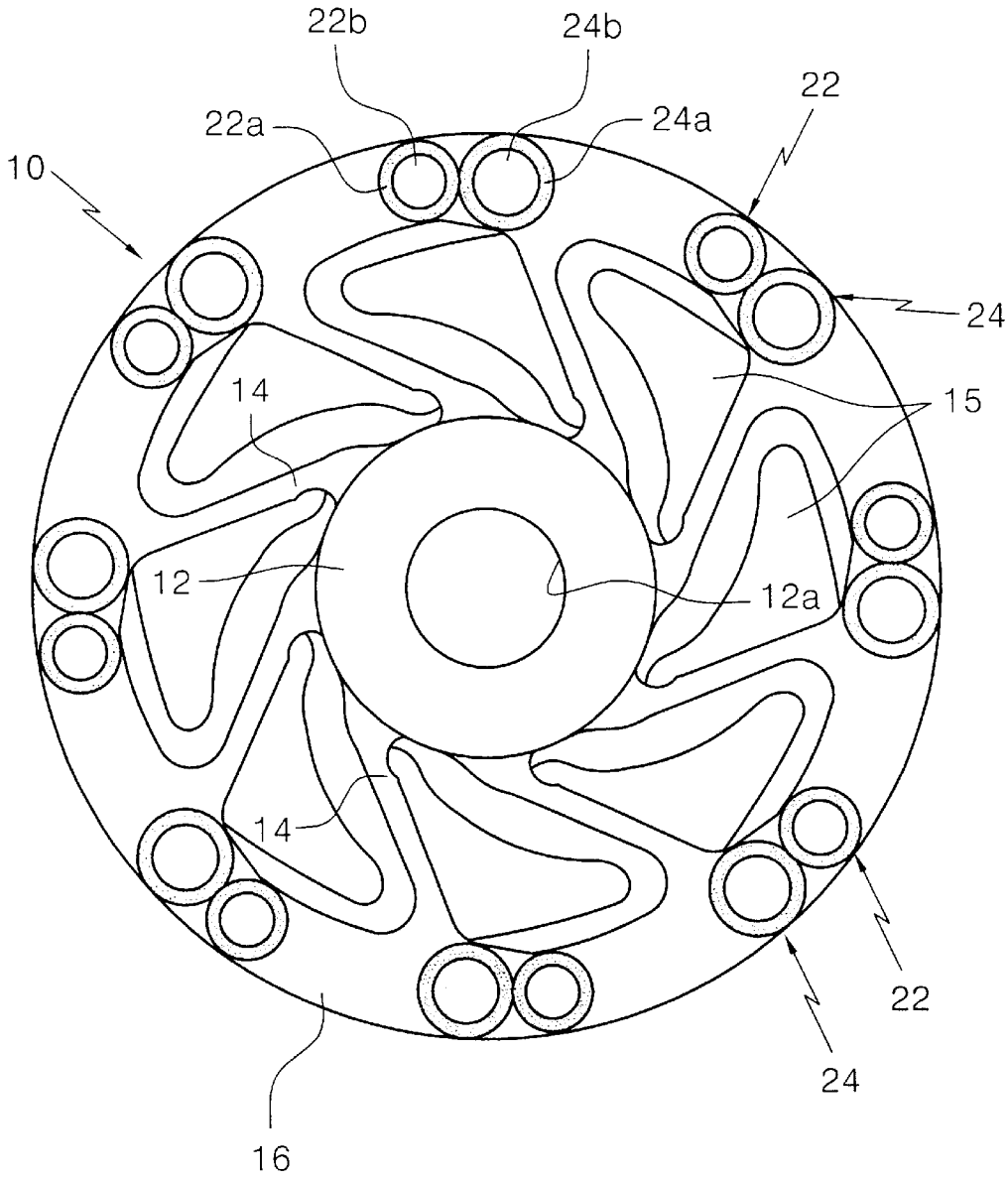
FIG. 1 shows the view of the underside of a grinding wheel according to a first embodiment of the invention.
Figure 2:
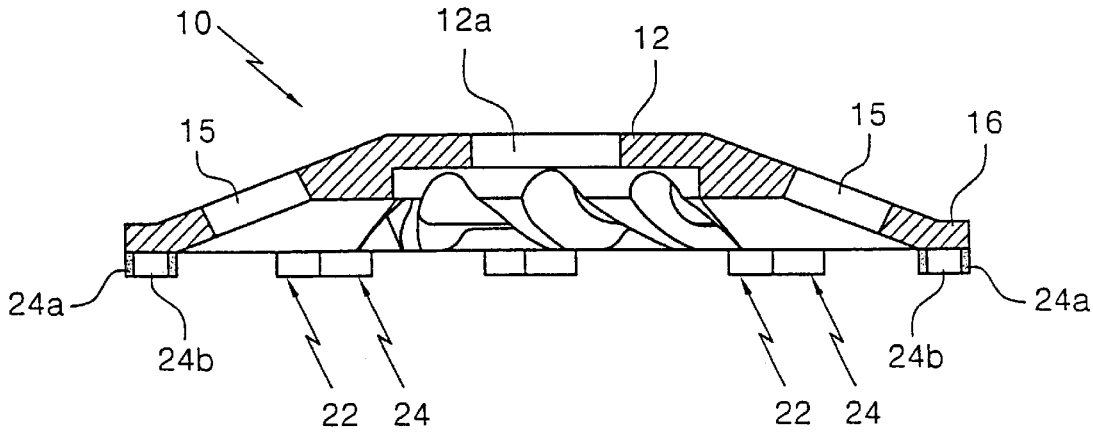
FIG. 2 shows the cross sectional view of a grinding wheel according to a first embodiment of the invention.

The grinding wheel 10, as shown in FIGS. 1 and 2, comprises a disk part 12 with a mounting hole 12*a* for mounting the output terminal of a motor-operated tool for rotation about an axis, a plurality of rib parts 14 extending radially from the disk part 12 and a rim part 16 for connecting the rib parts 14 to the circumference, the overall contour of the rib parts being in a conical cup form. The numeral 15 references a dust discharging hole.

Grinding segments 22 and 24 are attached to the underside of the rim part 16 of a grinding wheel 10 and each includes a grinding surface facing in the direction of the axis. The grinding surface is demarcated into an inner part and an outer part about a demarcating interface. The outer parts are treated so as to constitute a higher wear resisting region in comparison to the inner parts by controlling the particles size and/or the content of the super abrasive such as diamond particles or cubic boron nitride particles or by controlling the degree of the hardness of the metal bonding material for binding the abrasive particles together.

The inner parts mean the central portions of the segments 22 and 24 and the outer parts make up the edge portions of the segments enclosing the central portions with predetermined thickness, as shown in dotted circles and black rings in FIG. 1. Thus, the outer or edge portions have a higher wear resistance than the inner or central portions according to the invention.

The shape of the segments employed in this invention may include that of circle, ellipse, streamline and the like so as to easily discharge ground chips.

Generally, the grinding segments are composed of the super abrasive including diamond particles and cubic boron nitride particles with a predetermined size and the metal bonding agent for binding the super abrasive particles together.

Accordingly, the present invention provides effective measure for preventing one-sided wear through control of the particle size and content of super abrasive as well as the hardness of metal bond in fabricating grinding segments.

EXAMPLE 1

This example relates to a grinding wheel in which grinding segments 22 and 24 are made in the form of a circular disc with a constant thickness, wherein small size and larger amount of super abrasive particles are distributed in the outer portions 22*a* and 24*a* while relatively larger size but smaller amount of super abrasive particles are distributed in the inner portions 22*b* and 24*b*. Thus, in this example, based on the intersection surface of the outside portion with the inside portion as the reference surface, the outer portions have a higher wear resistance than the inner portions.

Here, a larger or smaller size of particles is referred to the unit of mesh.

For example, when super abrasive particles with 80/90 mesh are used in an outer portion, then in the inner portion super abrasive particles of 40/50 mesh are used.

The meaning of more or less amount refers to the concentricity of diamond. The concentricity of 100 is equivalent to about 4.4 carats of diamond per 1 cc. Thus, for example, in case the concentricity of super abrasive in outer portions 22*a* or 24*a* of segments 22 or 24 amounts to 60, the corresponding value in the inner portions 22*b* or 24*b* should be lower than 60.

FIG. 1 shows an example of arrangement where a multitude of pairs each consisting of a smaller segment 22 and larger segment 24 are disposed on the underside of a rim part 16 of a grinding wheel 10, but the invention does not restrict to that arrangement.

When a grinding wheel 10 with segments for preventing one-sided wear as constructed above is put to use for grinding operation, a uniform wear of the grinding wheel results as the outer portion 22*a* and 24*a* of segments can work more efficiently than the inner portions 22*b* and 24*b*.

Consequently, the ground surface of an article is improved in processed quality due to the uniform wear and the service life of a tool can be increased.

EXAMPLE 2

Example 2 relates to the case wherein super abrasive is used in the same manner in the particle size and content in both the outer and inner portions 22*a*, 24*a* and 22*b*, 24*b*, but in the outer portions 22*a* and 24*a* a harder metal bond is used than in the inner portions 22*b* and 24*b*.

Here, the metal bond indicates to the metal powder in sintered state and functions to bind the super abrasive particles together during the sintering step. Therefore, the hardness of a metal bond corresponds to the hardness of the metal.

According to this example, the wear resistance of the outer portions 22*a* and 14*a* is superior to that of the inner portions 22*b* and 24*b* owing to the higher hardness of the metal bond, with result that similar excellent effect as in the previous example is attained.

EXAMPLE 3

This example relates to the arrangement of the super abrasive and metal bond in such a manner that in the outer portions 22*a* and 24*a* of segments a larger amount of smaller sized super abrasive powders are distributed in harder metal bond while in the inner portions 22*b* and 24*b* of segments a lesser amount of larger sized super abrasive powders are distributed in soft metal bond.

This arrangement for segments 22 and 24 is equivalent to the combination of the Example 1 and Example 2 and so naturally the increased concentricity of hard materials in the outer portions compared to the inner portions makes the grinding wheel more resistant to the one-sided wear.

EXAMPLE 4

Figure 3:
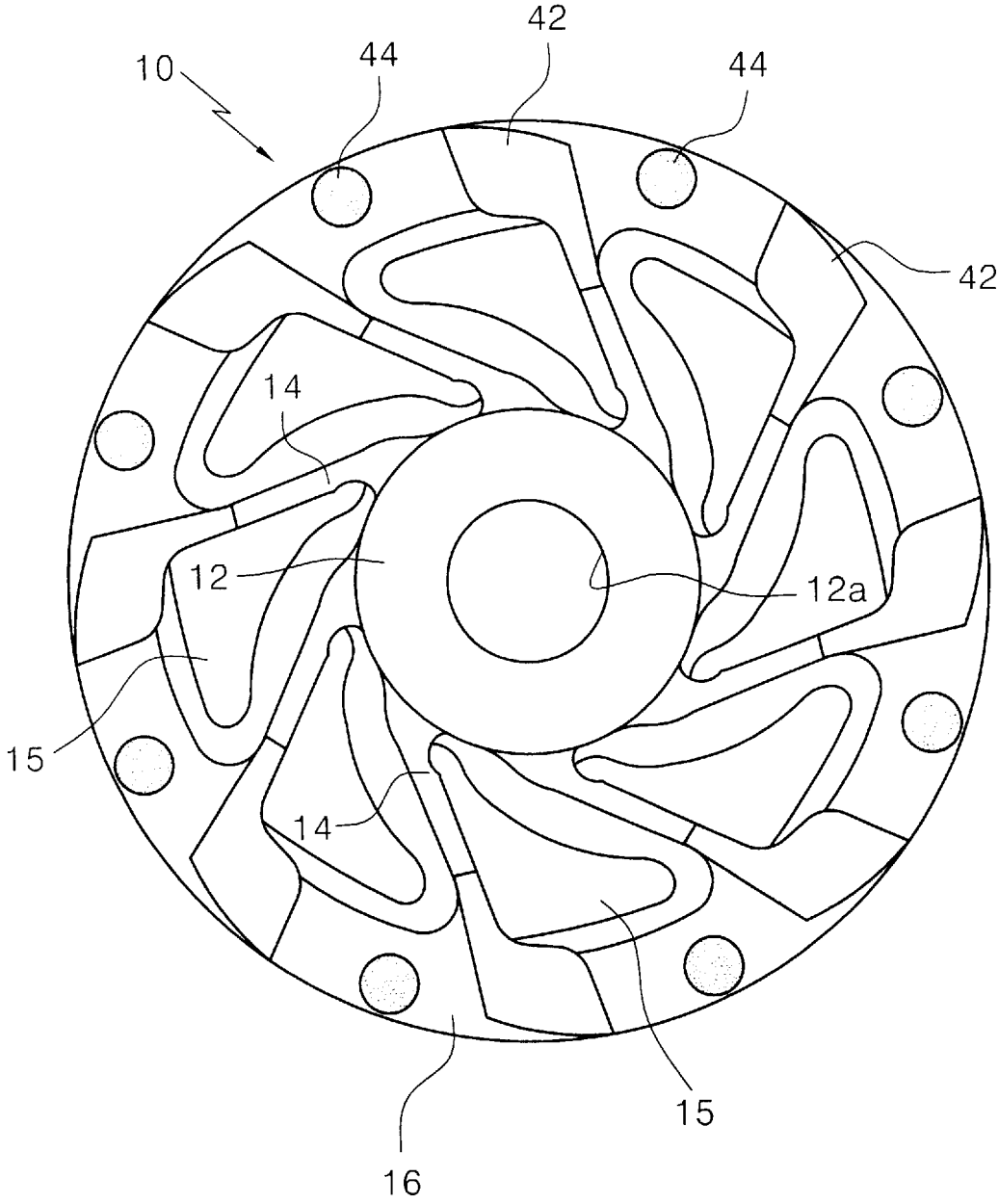
FIG. 3 shows the view of the underside of a grinding wheel according to another embodiment of the invention.

The grinding wheel corresponding to this example is represented in FIG. 3.

In this example, a number of soft segments 42 in extended manner to the ribs 14 and a number of hard segments 44 located between respective neighboring soft segments 42 are attached to the underside of the rim part 16, as shown in FIG. 3. As in the previous cases, the hard segments 44 in this example have a higher resistance against wearing in grinding operation than the soft segments 42.

The soft segments 42 may comprise a smaller amount of large sized super abrasive particles distributed in soft bond, while the hard segments 44 may comprise a larger amount of small sized super abrasive particles distributed in hard bond. Preferably, the hard segments 44 are positioned near the radially outermost area of the underside of the rim part 16.

The grinding wheels 10 according to Example 1 to Example 3 were designed to cope with one-sided wear under grinding load by dividing each of the segments 22 and 24 into an inner less resistant portion and an outer more resistant portion through the adjustment of the particle size and content for the super abrasive and/or the hardness for the metal bond.

In contrast to this, this fourth example attains its goal of preventing the biased wear by providing the hard segments 44 and the soft segments 42 separately and causing the hard segments 44 to remedy the possible one-sided wear due to the soft segments 42.

It is to be understood that, while the invention was described only with respect to several preferred embodiments of a grinding wheel, the invention is never restricted to those embodiments and a variety of modifications and alterations would be possible to a man skilled in the art by referring to the description or drawings presented here and within the spirit of the invention and thus those modifications or alterations are to fall within the scope of the invention, which scope should be limited only by the attached claims.

What is claimed is:

1. A grinding wheel comprising a plurality of hard segments and soft segments attached to the underside of a rim part of a grinding wheel, a rim part for supporting the segments, rib parts for connecting the rim part with a disk part, and a disk part with a central hole for connection to a motor-operated tool, wherein super abrasive particles with a smaller particle size in a larger amount are distributed in a hard bonding material in said hard segments, while super abrasive particles with a larger particle size in a small amount are distributed in a soft bonding material in said soft segments, in order to prevent one-sided wear.

2. The grinding wheel according to claim 1, wherein the hard segments are arranged on the outermost area of the rim part.

3. A grinding wheel comprising:

a disk part with a central hole adapted for connection to a motor-operated tool for rotation about an axis;

a rim part;

rib parts extending between the disk part and the rim part; and a plurality of circumferentially spaced segments attached to an underside of the rim part;

wherein the segments comprise super abrasive particles disposed in a metal bonding material; each segment demarcated into an inner portion and an outer portion together defining a grinding surface facing in a direction of the axis; the outer portion extending around the inner portion and forming a demarcating interface therebetween; and the outer portion forming a higher wear-resisting region than the inner portion depending on a size of the super abrasive particles and/or a content of the super abrasive particles and/or a hardness of the metal bonding material bonding the super abrasive particles together.

4. The grinding wheel according to claim 3, wherein the super abrasive particles in the outer portion are smaller than, and distributed in a larger amount than, the super abrasive particles in the inner portion.

5. The grinding wheel according to claim 3, wherein the metal bonding material of the outer portion is harder than the metal bonding material of the inner portion; the super abrasive particles of the outer portion being of the same size as, and distributed in the same amount as, the super abrasive particles of the inner portion.

6. The grinding wheel according to claim 5, wherein the metal bonding of the outer portion is harder than the metal bonding material of the inner portion.

* * * * *